US006768255B1

(12) United States Patent
Na

(10) Patent No.: US 6,768,255 B1
(45) Date of Patent: Jul. 27, 2004

(54) FLAT PANEL DISPLAY

(75) Inventor: Yang-Woon Na, Suwon (KR)

(73) Assignee: Samsung SDI Co., Ltd., Suwon-si (KR)

( * ) Notice: Subject to any disclaimer, the term of this patent is extended or adjusted under 35 U.S.C. 154(b) by 264 days.

(21) Appl. No.: 09/641,987

(22) Filed: Aug. 17, 2000

(30) Foreign Application Priority Data

Aug. 20, 1999 (KR) ..... 10-1999-34629

(51) Int. Cl.[7] ..... H01J 19/42

(52) U.S. Cl. ..... 313/495; 313/497; 313/306; 313/292

(58) Field of Search ..... 313/495–497, 313/306, 309, 462, 482, 268, 292, 582, 584, 586, 587; 345/60

(56) References Cited

U.S. PATENT DOCUMENTS 5,543,683 A 8/1996 Haven et al. ..... 313/461
5,650,690 A 7/1997 Haven ..... 313/422
5,731,660 A * 3/1998 Jaskie et al. ..... 313/495
5,859,497 A * 1/1999 Anderson et al. ..... 313/495
5,888,112 A * 3/1999 Alwan ..... 445/24
6,249,264 B1 * 6/2001 Sano et al. ..... 313/586

* cited by examiner

*Primary Examiner*—Ashok Patel
(74) *Attorney, Agent, or Firm*—Christie, Parker & Hale, LLP

(57) ABSTRACT

A flat panel display includes a faceplate, and a backplate combined with the faceplate to form a vacuum tight cell. An image production unit is provided within the cell to produce display images from the cell. A plurality of spacers are mounted within the cell such that the spaces are placed at a non-display area. The spacers are held between the faceplate and the backplate. A pair of alignment members are connected to the spacers in a body to align the spacers at the non-display area in a constant manner.

17 Claims, 3 Drawing Sheets

FLAT PANEL DISPLAY

BACKGROUND OF THE INVENTION (a) Field of the Invention

The present invention relates to a flat panel display and, more particularly, to a flat panel display which has spacers for maintaining the cell gap in a constant manner.

(b) Description of the Related Art

Generally, flat panel displays (FPDs) have a faceplate, a backplate, and a side wall that are combined together to form a vacuum tight cell. The vacuum degree of the cell is established to be about $10^{-7}$ torr.

In such a flat panel display, compared to other display devices, it is difficult to constantly maintain the cell gap due to the difference between the internal pressure and the external atmospheric pressure. For this reason, one or more spacers are provided within the cell to maintain the cell gap in a constant manner.

U.S. Pat. No. 5,650,690 or U.S. Pat. No. 5,543,683 discloses a method of fabricating a field emission display that has a gripper disposed on the faceplate, a locator disposed on the backplate, and a spacer wall interposed between the gripper and the locator. The spacer wall for securing the internal space of the device is formed with ceramic or glass, and interposed between the faceplate and the backplate via the gripper and the locator.

However, in the above structure, the gripper and the locator for holding the spacer wall should be separately provided, resulting in increased production cost and complicated processing steps (for example, photolithography for a photosensitive material).

Furthermore, in order to fit the spacer wall between the gripper and the locator, each spacer should be inserted into the gripper or the locator. This requires elaborate working conditions while making it difficult to maximize work efficiency.

SUMMARY OF THE INVENTION

It is an object of the present invention to provide a flat panel display which can mount spacers without separate fixation members.

It is another object of the present invention to provide a flat panel display which can be fabricated in a simplified manner.

These and other objects may be achieved by a flat panel display including a faceplate, and a backplate combined with the faceplate to form a vacuum tight cell. An image production unit is provided within the cell to produce display images from the cell. A plurality of spacers are mounted within the cell such that the spacers are placed at a non-display area. The spacers are held between the faceplate and the backplate. A pair of alignment members are connected to the spacers in a body to align the spacers at the non-display area in a constant manner.

Each alignment member is connected to one-sided end portions of the spacers. A longitudinal axis of each spacer is preferably positioned substantially parallel to a side of the cell.

A pair of subsidiary alignment members may be arranged perpendicular to the alignment members to form a rectangular frame.

Each spacer is provided with a plurality of exhaust grooves. The exhaust grooves are arranged at the spacer in the longitudinal direction while being spaced apart from each other with a predetermined distance.

Each spacer may be further provided with a plurality of grooves for preventing image distortion. The image distortion preventing grooves are arranged at the spacer in the longitudinal direction while being spaced apart from each other with a predetermined distance.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or the similar components, wherein.

DETAILED DESCRIPTION OF THE PREFERRED EMBODIMENTS

Preferred embodiments of this invention will be explained with reference to the accompanying drawings.

Figure 1:
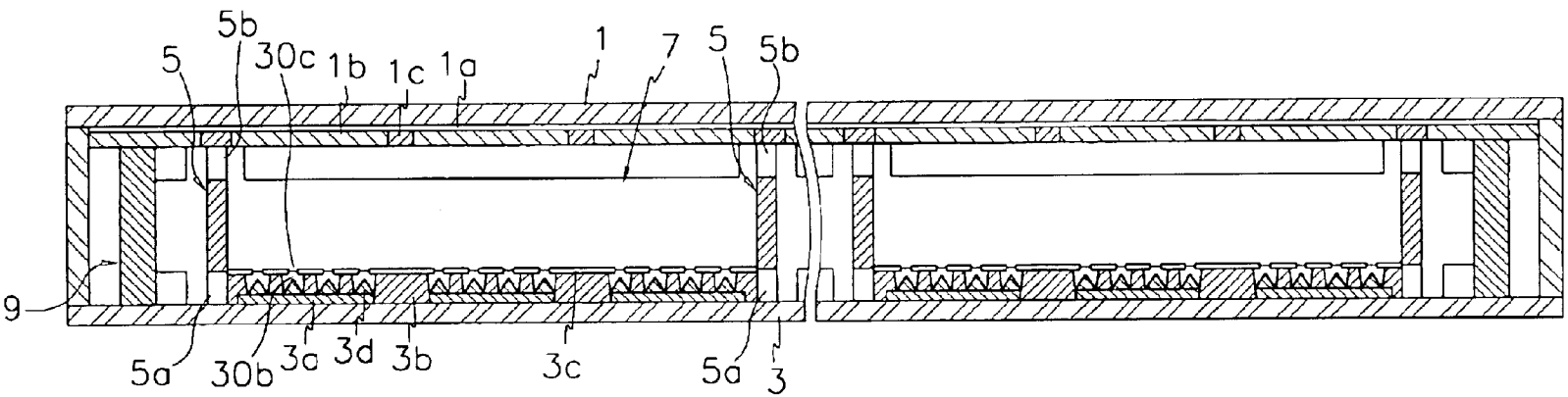
FIG. 1 is a cross sectional view of a flat panel display according to a preferred embodiment of the present invention.

FIG. 1 is a cross sectional view of a flat panel display according to a preferred embodiment of the present invention where a field emission display (FED) is exemplified as the flat panel display.

The field emission display includes a faceplate 1, and a backplate 3 spaced apart from the faceplate 1 by with a predetermined distance and positioned while proceeding parallel thereto. The faceplate 1 is combined with the backplate 3 to thereby form a vacuum tight cell.

The faceplate 1 is sequentially overlaid with an anode electrode 1*a,* and a plurality of phosphor layers 1*b* placed at an even plane in with a predetermined pattern. A black matrix 1*c* surrounds the phosphorous layers 1*b* to improve contrast, the black matrix 1*c* being and formed with chrome (Cr) or chrome/chrome oxide layer ($Cr/CrO_x$).

The backplate 3 is overlaid with a plurality of cathode electrodes 3*a* placed at an even plane in a stripe pattern while facing the anode electrode 1*a*. A plurality of gate electrodes 3*c* crosses the cathode electrodes 3*a* by interposing an insulating layer 3*b*. The gate electrodes 3*c* are also formed in with a stripe pattern.

The insulating layer 3*b* has breakthrough holes 30*b* at the positions where the cathode electrodes 3*a* and the gate electrodes 3*c* cross each other, and the gate electrodes 3*c* has also opening portions 30*c* at those positions. A microtip-based field emitter 3*d* is placed on the cathode electrode 3*a* within the area of each breakthrough hole 30*b*.

A plurality of spacers 5 are held between the faceplate 1 and the backplate 3. The spacers 5 are positioned at the non-display area in the cell where light is intercepted by the black matrix 1*c*.

Figure 2:
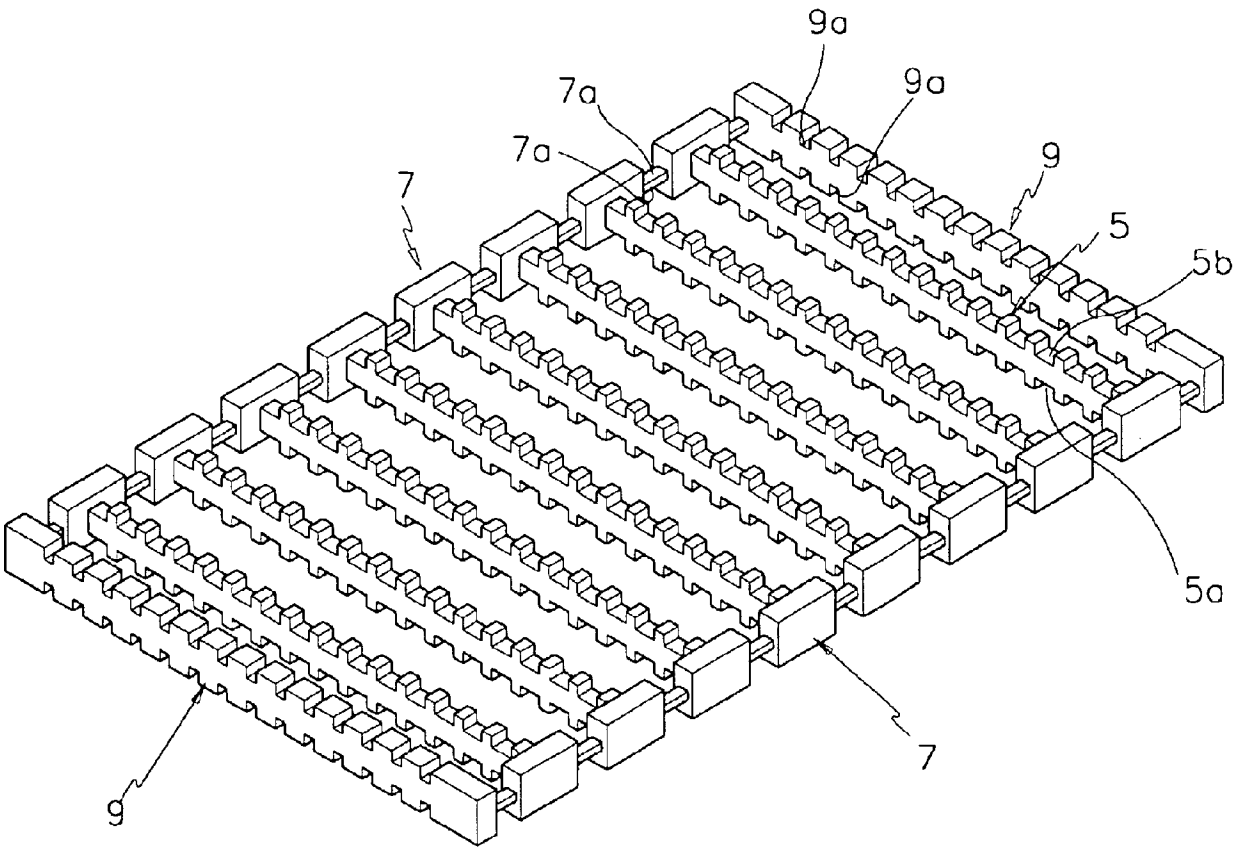
FIG. 2 is a perspective view of a spacer structure for the flat panel display shown in FIG. 1.

As shown in FIG. 2, the spacers 5 are positioned parallel to proceed along the short sides of the plates 1 and 3. Of course, the spacers 5 may alternatively be positioned parallel to proceed along the long sides of the plates 1 and 3. A pair of alignment members 7 are integrally provided each at one-sided end portions of the spacers 5 to hold the spacers 5 at the non-display area in a constant manner.

Subsidiary alignment members 9 are integrally provided each at one-sided end portions of the alignment members 7 to further reinforce the holding state of the spacers 5.

That is, the alignment members 7 and the subsidiary alignment members 9 altogether form a rectangular frame, and this frame can serve to maintain the spacers 5 at proper places in a constant manner.

In the field emission display having the above spacer structure, after field emission components are provided between the plates 1 and 3, the plates 1 and 3 are sealed together to form a vacuum tight cell. The vacuum degree of the cell is controlled to be about $10^{-7}$torr through exhaustion.

However, in case the exhaustion process is performed in such a state that the spacers 5, the alignment members 7 and the subsidiary alignment members 9 are mounted between the plates 1 and 3 in the longitudinal direction, it is difficult to expect fluent exhaustion due to the spacer components 5, 7 and 9.

Therefore, in this preferred embodiment, a plurality of exhaust grooves 5*a* are formed at each spacer 5 to realize fluent flowing of exhaust gas within the cell. The exhaust grooves 5*a* are arranged at the spacer 5 in the longitudinal direction and are positioned adjacent to the backplate 3. The exhaust grooves 5*a* are spaced apart from each other by a predetermined distance.

Furthermore, a plurality of image distortion preventing grooves 5*b* are formed at each spacer 5 and are positioned adjacent to the faceplate 1. The image distortion preventing grooves 5*b* are to reduce the contact area between the spacer 5 and the faceplate 1, thereby minimizing distortion of picture images due to the contact resistance. The image distortion preventing grooves 5*b* are spaced apart from each other by a predetermined distance in one to one correspondence with the exhaust grooves 5*a*.

Exhaust grooves 7*a* and 9*a* are arranged along the alignment members 7 and the subsidiary alignment members 9, the grooves 7*a* and 9*a* being symmetrically positioned adjacent to, respectively, the faceplate 1 and the backplate 3. The exhaust grooves 7*a* or 9*a* are spaced apart from each other by a predetermined distance.

Figure 3:
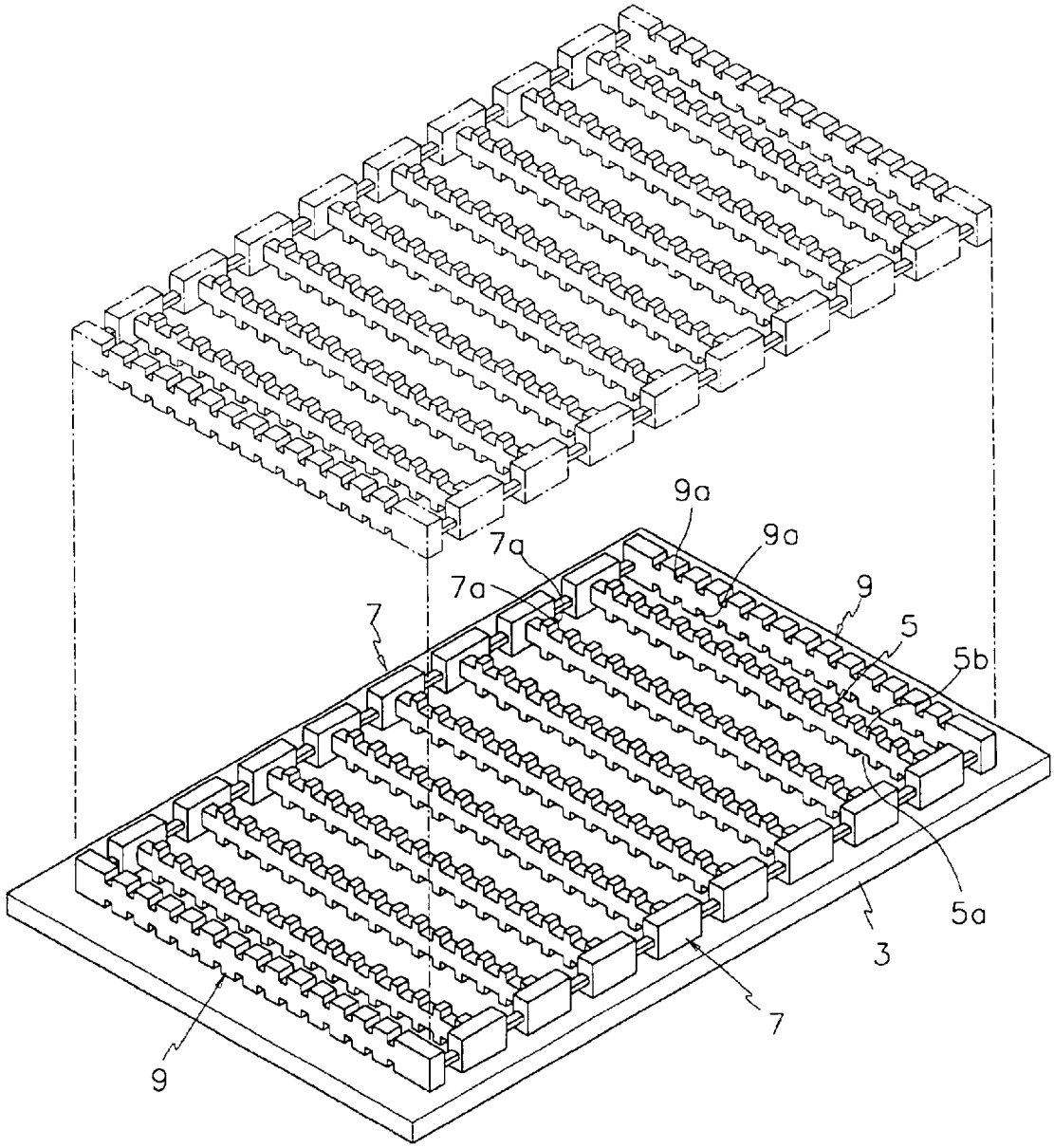
FIG. 3 is a perspective view of a spacer structure fixed to a plate for the flat panel display shown in FIG. 1.

As shown in FIG. 3, in the fabrication process, the spacers 5 are mounted on the backplate 3 while being held by the alignment members 7 and the subsidiary alignment members 9. At this time, the position control of the spacers 5 can be easily performed once for all spacers 5 due to the presence of the frame structure, and, after the mounting, stable positioning thereof can be obtained.

In accordance with the present embodiment of the invention, the spacers 5, the alignment members 7 and the subsidiary alignment members 9 are formed with a photosensitive glass. The photosensitive glass is exposed to light through an appropriately patterned mask, the light-exposed glass is baked at the furnace, and the baked glass is etched to form the spacer structure with groove patterns.

Alternatively, in addition to field emission displays, the above structure may be applied to other flat panel displays such as flat cathode ray tubes.

As described above, in the inventive flat panel display, a plurality of spacers are easily positioned at the non-display area through a single position controlling step so that the production efficiency can be significantly enhanced.

While the present invention has been described in detail with reference to the preferred embodiments, those skilled in the art will appreciate that various modifications and substitutions can be made thereto without departing from the spirit and scope of the present invention as set forth in the appended claims.

What is claimed is:

1. A flat panel display comprising:

a faceplate;

a backplate combined with the faceplate to form a vacuum tight cell;

an image production unit provided within the cell to produce display images from the cell;

a plurality of spacers mounted within the cell such that the spacers are placed at a non-display area and extend substantially across the cell, the spacers being held between the faceplate and the backplate, wherein each of the plurality of spacers includes a plurality of exhaust grooves to enable fluid gas flow within the cell;

a pair of alignment members connected to the spacers such that the spacers and alignment members form an integral spacer body, to align the spacers at the non-display area in a constant manner; and a pair of subsidiary alignment members, wherein the subsidiary alignment members are attached substantially perpendicular to the alignment members to form a substantially rectangular spacer holding state reinforcement frame enclosing the spacers.

2. The flat panel display of claim 1, wherein each alignment member is connected to one-sided end portions of the spacers.

3. The flat panel display of claim 1, wherein a longitudinal axis of each spacer is positioned substantially parallel to a side of the cell.

4. The flat panel display of claim 1, wherein the image production unit comprises:

a plurality of cathode electrodes formed at the backplate in a predetermined pattern;

an insulating layer formed at the backplate, the insulating layer having a plurality of breakthrough holes formed over the cathode electrodes;

a plurality of emitters contacting the cathode electrodes, each emitter being disposed within one of the breakthrough holes;

a plurality of gate electrodes formed on the insulating layer in a predetermined pattern, the gate electrodes having openings communicating with the breakthrough holes;

an anode electrode formed on the faceplate and facing the gate electrodes; and a plurality of phosphor layers formed on the anode electrode in a predetermined pattern.

5. The flat panel display of claim 1, wherein the vacuum degree of the cell is kept to be substantially $10^{-7}$ torr.

6. The flat panel display of claim 1, wherein the exhaust grooves of each spacer are positioned along a length of the spacer while being spaced apart from each other by a predetermined distance.

7. The flat panel display of claim 1, wherein each spacer is provided with a plurality of image distortion prevention grooves.

8. The flat panel display of claim 7, wherein the image distortion preventing grooves of each spacer are positioned along a length of the spacer while being spaced apart from each other by a predetermined distance.

9. The flat panel display of claim 7, wherein the exhaust grooves are positioned adjacent to the backplate and the image distortion grooves are positioned adjacent to the faceplate, and wherein the image distortion preventing grooves are in one to one correspondence with the exhaust grooves with respect to a longitudinal axis of the spacer.

10. The flat panel display of claim 1, wherein each alignment member is formed with a plurality of exhaust grooves.

11. The flat panel display of claim 10, wherein the exhaust grooves of the alignment member are positioned along a length of the alignment member.

12. The flat panel display of claim 11, wherein the exhaust grooves of the alignment member are arranged symmetrical to each other with respect to a longitudinal axis of the alignment member.

13. The flat panel display of claim 1, wherein each subsidiary alignment member is provided with a plurality of exhaust grooves.

14. The flat panel display of claim 13, wherein the exhaust grooves of the subsidiary, alignment member are positioned along a length of the subsidiary alignment member while being spaced apart from each other by a predetermined distance.

15. The flat panel display of claim 14, wherein the exhaust grooves are arranged symmetrical to each other with respect to a longitudinal axis of the subsidiary alignment member.

16. A spacer apparatus for a flat panel display, the spacer apparatus comprising:

a plurality of spacers for mounting within a vacuum tight cell of a flat panel display such that the spacers are placed at a non-display area and extend substantially across the cell;

a pair of alignment members connected to the spacers such that the spacers and alignment members form an integral spacer body, to align the spacers at the non-display area in a constant manner, wherein each of the plurality of spacers includes a plurality of exhaust grooves to enable fluid gas flow within the cell; and a pair of subsidiary alignment members, wherein the subsidiary alignment members are attached substantially perpendicular to the alignment members to form a substantially rectangular spacer holding state reinforcement frame enclosing the spacers.

17. The spacer apparatus of claim 16, wherein the exhaust grooves of each spacer are positioned along a length of the spacer while being spaced apart from each other by a predetermined distance, and wherein each spacer is provided with a plurality of image distortion prevention grooves, the image distortion preventing grooves of each spacer being positioned along a length of the spacer while being spaced apart from each other by a predetermined distance, and wherein the image distortion preventing grooves are in one to one correspondence with the exhaust grooves with respect to a longitudinal axis of the spacer.

* * * * *